United States Patent [19]

Brest van Kempen

[11] Patent Number: 4,759,888

[45] Date of Patent: Jul. 26, 1988

[54] METHOD FOR AUTOMATICALLY INSTALLING AND TESTING GROUTED ROCK BOLTS

[76] Inventor: Carel J. H. Brest van Kempen, 4920 Emigration Canyon, Salt Lake City, Utah 84108

[21] Appl. No.: 748,813

[22] Filed: Jun. 26, 1985

[51] Int. Cl.[4] ..... B28B 7/38; B29B 7/42; E21D 20/02; F16B 31/06

[52] U.S. Cl. ..... 264/35; 264/40.1; 405/260; 411/1

[58] Field of Search ..... 264/31, 35, 40.1; 405/260, 261; 411/1-7

[56] References Cited

U.S. PATENT DOCUMENTS

| | | | |
|---|---|---|---|
| 4,094,157 | 6/1978 | Karsten et al. | 405/260 |
| 4,300,397 | 11/1981 | Brest van Kempen | 73/818 |
| 4,347,020 | 8/1982 | White et al. | 411/5 |
| 4,352,600 | 10/1982 | Brest van Kempen | 405/259 |
| 4,398,850 | 8/1983 | Talvensaari | 405/261 |
| 4,444,530 | 4/1984 | Brest van Kempen | 405/259 |
| 4,477,209 | 10/1984 | Hipkins, Jr. et al. | 411/5 |
| 4,518,292 | 5/1985 | Calandra, Jr. | 411/4 |
| 4,564,315 | 1/1986 | Rozane | 405/260 |
| 4,607,984 | 8/1986 | Cassidy | 405/261 |

OTHER PUBLICATIONS

Haakebuchler Instruments Brochure No. RC 982/583, "Rheocord System 40 Microprocessor Controlled Torque Rheometer".

DuPont Fasloc Brochure No. E-12552, 2/77, Resin Anchored Bolt System.

Haake Tech. Abst., TA-42, "Characterization of the Time Temperature-Viscosity Behavior of Curing B-Staged Epoxy Resin".

Haake Buchler Tech. Bulletin, "Quality Control & Compound Formulation Research & Development of Thermosetting Plastics."

Geodynamik AB, "Bollometer" Brochure, U.S. Bureau of Mines Technology News, No. 128 1/82.

*Primary Examiner*—Jan H. Silbaugh

*Assistant Examiner*—Karen D. Kutach

[57] ABSTRACT

Means and method for improving productivity and quality of grouted rock bolt installations. The invention provides means of automatically installing full length grouted bolts as well as tensioned (point anchor) grouted bolts, which ensures proper shredding of the grout package, proper mixing and proper curing of the grout, and minimizing machine time involvement. The invention also makes it possible to include a test for quality on each grouted bolt installed, within the automatic installation cycle. The invented means further allows control of the depth of holes drilled for rock bolting and automatic freeing of drill steels, where they may be danger of drill steel binding during drilling for rock bolting.

3 Claims, 1 Drawing Sheet

METHOD FOR AUTOMATICALLY INSTALLING AND TESTING GROUTED ROCK BOLTS

FIELD OF THE INVENTION

This invention addresses itself to the field of reinforcing ground by means of devices known collectively as rock bolts or, in many underground mining applications, as roof bolts, and specifically to those rock or roof bolts which are fastened in place by grouting a portion of their length or their full length in place.

BACKGROUND OF THE INVENTION

Roof bolting is used as the primary means of roof support in underground mines using the room and pillar mining method, currently between 85% and 90% of U.S. underground coal mines.

The invention pertains to those roof bolts which are grouted in place, either along their entire length or along a portion of their length. In this application of roof bolting, typically four to six foot deep, one inch diameter holes are drilled in the overlying rock strata. These holes are typically spaced on a four foot square grid. Sausage shaped cartridges are inserted in these holes, often temporarily held in place by plastic wedges or caps. The cartridges contain the components of the grout. The grout is normally separated in two portions which, when mixed together, cause the grout to solidify in a competent mass. In the popular polyester resin grout, one of the two portions of the grout contains primarily a thermoset monomer, which is extended with fillers; the other of the two portions contains a catalyst. The two portions are separated in the cartridge by a longitudinal membrane. In a more recent innovation, the two portions are gypsum powder and water, the water being held in separation from the gypsum by encapsulation in 1/16 inch diameter wax containers, which are dispersed through the gypsum in the correct proportion for solidification after mixing. After the cartridges are placed in a previously drilled hole in the mine roof, subsequent insertion of the reinforcing roof bolt, usually a deformed steel bar, with a bolt head and roof plate at the lower end, ruptures the separating membrane or the wax pellets, as well as the wrapping material which forms the cartridge, thus initiating contact between the two components of the grout and spilling the grout in the annular space between the roof bolt and the rock wall of the hole. The roof bolt is rotated for a short period of time to promote mixing of the two portions of the grout. The rotating action also heats the grout, further promoting a rapid cure. After a brief interval, rotation of the bolt is stopped and the bolt is held in position for a period of sufficient duration, typically somewhere between 20 seconds and a minute, for the grout to cure sufficiently to prevent the bolt from falling out of the roof, if the bolt is no longer held.

PROBLEMS WITH CURRENT PRACTICE

Although satisfactory results have been experienced in applying the grouted bolt method of roof support, several problems do commonly occur, and this invention intends to provide the means to solve such problems.

The problems mentioned all have to do with the grouted bolt installation procedure or method, which in turn is limited in effectiveness by the devices available to accomplish such installation. All of the problems referred to result in practice in lack of certainty about the soundness and performance of any given individual roof bolt. To appreciate the potential seriousness of this flaw, consider the fact that wherever a bolt is not properly grouted or the grout has not cured properly, the bolt may, for purposes of contribution to roof reinforcement, be considered absent or removed. Since the roof-bolts are normally installed on equal spacings, removing a bolt in this way doubles the unsupported span of the roof structure. If this is done in a conventional beam, stresses in the beam are quadrupled. It is then only a matter of time, as mining advances, for a randomly "absent" bolt to coincide with a local weakness in the roof structure and trigger a roof fall. An analysis of the situation just described allows a breakdown of the operation of installing grouted roof bolts into specific problem areas, which can then be individually addressed for solution.

One problem is associated with the wrapping material which forms the grout cartridge: when the roof bolt ruptures the wrapping material, sometimes the rupture is incomplete, producing what is commonly referred to by the descriptive phrase "the finger in glove effect". When this happens, even when the grout cures completely and properly, the reinforcing strength of the roof bolt is severely compromised by the fact that the grout is totally surrounded and separated from the rock by the wrapping material. This problem is virtually eliminated if the roof bolt is slowly rotated as it is driven up through the grout package. Such slow rotation, however, is difficult to control on a conventional roof bolting machine.

A second problem is associated with the mixing phase of the roof bolt installation operation. During the mixing phase, the roof bolt must be rotated rapidly until mixing is complete. In the typical case, mixing may have to be performed for 15 or sometimes 20 seconds. With certain new fast curing resins, the necessary mix time may be less than 10 seconds. Completeness of subsequent cure of the grout at all locations within the grout is highly dependent upon sufficient mixing. Excessive mixing, on the other hand, results in the destruction of chemical links already formed within the grout structure. Since such broken links do not repair themselves afterward, excessive mixing can easily result in substantial detraction from the final strength of the installation. In present practice, it is left to the roof bolter operator to stop the mixing rotation manually at the proper moment for each individual bolt. Mental judgement of elapsed time is the controlling technique normally used by the operator. The necessary split-second timing simply cannot be achieved this way. Moreover, actual optimum mixing time is not constant to begin with, but is influenced by factors such as the age and condition of the grout packages, as well as by the ambient temperature. Another problem connected with the mixing phase is the fact that it is highly desirable to maintain thrust exerted on the bolt head at a very low value during the high speed mix rotation, to avoid excessive heat generation at the bolt head. The Mine Safety and Health Administration of the Department of Labor has reported incidents where the grout mixture was actually ignited from the heat generated through excessive thrust as just described. Such combustion would be highly undesirable in the already hazardous environment of a coal mine. During the initial insertion of the roof bolt into and along the grout package, it is necessary to exert high thrust (frequently exceeding 2000 lbs, although it should be recognized that rapid bolt insertion even at 2000 lbs can create hydraulic pressures within the liquid grout as high as 5000 psi; the higher the hydraulic pressure at this stage, the higher the probability of resultant damage to the roof structure and/or loss of grout through cracks and crevices in the roof structure: it is therefore necessary to exert careful control over insertion thrust as well as over bolt insertion travel rate) to be able to penetrate the grout mass. On the conventional bolting machine it is not feasible to exert manual control to the extent that thrust can be varied from a high value to a controlled low value. Therefore, to avoid the problem described above with high thrust on the bolt head during mixing, the bolt penetration movement is often halted by the operator a few inches before the bolt head and roof plate have reached the roof line. At this point the operator initiates high speed mixing. When he thinks sufficient mixing has taken place, the operator again applies high thrust to drive the bolt the rest of the way into the roof. The attendant problem is that such extreme axial movement (an inch or more) is virtually certain to sever any chemical bonds which may have formed at that time. An illustration of the fact that chemical bonds have normally formed at the time described is the not infrequent occurrence when it is not possible for the roof bolting machine to provide enough thrust at the conclusion of the mixing phase to drive the bolt all the way into the roof, with the result that the roof plate is left dangling loose from the extended bolt; this is another safety hazard.

Another common problem is control of the duration of the cure period. After completion of the mixing phase, the bolt is held in support by exerting a high thrust to the bolt head and the roof with the bolting machine, without rotation, for a period of time which is long enough to permit sufficient grout curing to avoid roof movement when the thrust and the bolting machine are removed. The high thrust applied during this period also acts to minimize any bad separations within the roof strata which may be occurring. In present practice, the time the bolt is held in support by the machine is again controlled by the operator, and may be anything from 15 seconds to several minutes. On the average, the unavoidable result is excessive dwell time, which affects productivity. Since the roof bolting operation is usually the pacing element in the coal mining production cycle, such productivity decrease is potentially very serious in its effect upon profitability.

Another common problem arises from the fact that once the grouted bolt is installed, there is no simple way to test if it is sound. As is seen from the foregoing discussion, it can easily happen that some bolts do not have properly mixed or cured grout or that the grout packaging material is coincidentally disposed within or around the grout in such a manner as to interfere with the desired rock reinforcing function of the bolt.

The conventional test of applying a test torque to the roof or rock bolt head is relatively meaningless, since, if applied after the roof bolting machine has been removed from the bolt head, so that significant curing of the grout has taken place, the test can only indicate or disclose those bolts which are practically totally loose. To appreciate this fact, consider the following:

A typical grade 60 deformed steel roof bolt yields at a stress of 60,000 psi in tension, or approximately 30,000 psi in shear. The popular no. 6, or ¾ inch diameter roof bolt therefore yields at a torsional load of 207 lbft. The maximum test torque which can be applied must stay well below this value of 207 lbft. Equivalent bond shear strengths at the steel-grout interface reported by the industry are as high as 700 psi within fifteen minutes after mixing of the grout. The maximum grouted length which could be tested on a no. 6 bolt without twisting the bolt head on the body, is therefore less than four inches. In other words, if the lower four inches of the roof bolt are properly grouted and fully cured, the entire remaining length could be totally devoid of grout and yet the bolt head would yield in torsion, rather than show a defect in the grout.

The U.S. Bureau of Mines has recognized this problem by funding research on a roof bolt bond tester—cf. Bureau of Mines Technology News No. 128, January 1982. Although in principle the effort is commendable, the device performs its test in a separate operation, after the production bolting is completed. What is still lacking is a means of indicating quality of the grouting during the installation process, before temporary supports are removed from the roof.

In view of all the foregoing problems, it should be not surprising that as a result of tests performed in Canadian and Swedish mines, using a Swedish ultra sonic testing device, the conclusion was drawn that 20% to 40% of installed bolts were of insufficient grouting to be classified as safe.

In a recent innovation, the reinforcing action of full length grouted rock bolts has been improved by adding tension which is imposed upon the bolt during installation. To accomplish this, the grout is confined to the upper portion of the bolt by means of a sealing washer. The grout is mixed and cured as described before for the full length grouted bolt. The remaining length of bolt which has not been encased in grout contains a threaded connection which is subsequently tightened by the bolting machine to obtain the desired bolt tension. Since desired bolt tensions are normally in the range of 8000 to 10,000 lbs, it will be appreciated that an extremely quick-setting grout is called for in this application. Because of the concomitantly short reaction times associated with such quick-setting grout, all of the problems listed above are then further exacerbated.

OBJECTS OF THE INVENTION

This invention is accordingly directed to novel means and novel methods to install grouted rock bolts while eliminating or substantially reducing the common difficulties just described. A principal object of the invention is to increase mine safety by ensuring dependable mine roof support when using grouted rock bolts. An additional object of the invention is to increase mining productivity by minimizing the time required to install each grouted rock bolt, without compromising the quality of the installation. A further additional object of the invention is to improve safety and speed of grouted rock bolt applications by providing automatic controls which ensure proper mixing and proper curing of the grout, while minimizing the time involvement of installation machinery. A further additional object of the invention is to improve safety of grouted rock bolt applications by providing method and means to conduct a meaningful test on each rock bolt installed, as part of the bolt installation cycle; said test to provide a simple indication that proper mixing and proper curing of the grout have taken place.

Further objects and advantages of the invention will become apparent from a consideration of the drawings and ensuing description thereof. Similarly, it will become apparent from the detailed description of the invention, that useful application is not limited to underground roof bolting. Examples of additional fields of application include, but are not limited to, the anchoring of machinery or other structures to prior existing masonry, rock or rock-like masses. It should be noted that throughout this Specification, the terms "rock bolt" and "roof bolt" are used interchangeably. It should be similarly understood that the invention pertains to all grouted rock bolts, even though application of the invention to roof bolts may be of the greatest immediate interest.

SUMMARY OF THE INVENTION

The means and methods for controlling the installation parameters of a grouted rock bolt or roof bolt according to the invention, may be visualized as consisting of four parts:

means and method to insure proper bolt insertion in such a manner as to maximize shredding of the grout packaging material and to minimize migration of the grout away from its intended location, i.e. the previously drilled bolt hole;

means and method to insure proper mixing of the grout;

means of controlling the time that high thrust is applied to the surface of the rock mass to be reinforced while the grout is curing and increasing in strength;

means and method to apply a simple test to the grouted rock bolt, within its total installation cycle, to prove final reliability of that rock bolt.

The invention also makes it possible to integrate some or all of the four parts as just described in a single machine which then provides the capability to routinely remove or at least substantially reduce the hazard of malfunction at random of a portion of the roof bolt population installed.

The mentioned means and method to control the roof bolt insertion process becomes the first step in the bolt installation cycle as follows: when the roof bolting machine operator initiates the bolt installation process by suitable action such as the pushing of a button or the flipping of a toggle lever or switch means, after having first drilled a suitable hole in the rock mass to be reinforced, and after having first also inserted the grout cartridge or cartridges into a previously drilled hole in the rock mass to be reinforced, as well as after having first guided the roof bolt a short distance into said drilled hole, and having first connected the other end or head of the roof bolt to a bolt driving means on the roof bolting machine, the following actions are automatically caused to take place by the roof bolting machine:

The bolt is steadily pushed into mentioned drilled hole while penetrating the previously positioned grout cartridge. At the same time, a slow (approximately 60 RPM has been found to be a good choice in practice) rotation is applied to the bolt. As the bolt penetrates a greater distance into said drilled hole, the thrust which must be exerted on the bolt to maintain the steady penetrating movement as described increases. When the thrust as just described attains a threshold value which has been previously determined to be adequate to achieve full insertion, and yet not so high as to cause loss or migration of the grout as described above (a thrust of 2000 lbs or 2500 lbs has been found to be a good choice in practice), a thrust threshold sensing means switches a thrust controlling means to cause the amount of thrust applied to achieve insertion motion, to decrease to a value much lower than the threshold value just mentioned (a good choice for said lower thrust value has been found to be approximately 200 lbs); at the same time the mentioned thrust threshold sensing means switches a speed controlling means to cause the rotation rate of the roof bolt to increase to a set higher value (400 to 500 RPM has been found to be a good range in practice). The lower thrust value and higher rotation speed value are necessary for the next step in the bolt installation process as will be described in due time. It has been found that on occasion the thrust required during insertion may rise to the mentioned threshold value before the bolt is quite completely all the way inserted into the drilled hole. When this happens, however, the bolt travels the remaining distance to full insertion during the initial part of the next step, as will be described.

The means and method to insure proper mixing of the grout become the next step in the bolt installation cycle. The thrust controlling means and the rotation speed controlling means described in the previous bolt installation step are used to maintain the thrust and rotation speed at suitable low and high values (e.g. 200 lbs and 450 RPM), respectively. The low thrust is necessary to avoid excessive friction between the bolt head and the roof plate as was discussed in the section describing Problems with Current Practice. The high rotation speed is necessary to achieve rapid and thorough mixing of the grout. During the initial phase of the mixing process, the high rotation speed raises the temperature of the grout. This increase in temperature does not only accelerate the subsequent process of curing the grout, but first reduces the effective viscosity of the mixture, so that under the combined influence of the high rotation speed and low thrust, the bolt is readily driven up into the drilled hole any remaining distance possibly left after the previous high thrust insertion step, as described above. It is not feasible to delete the high thrust, low speed insertion step prior to activation of the low thrust, high speed mixing step for two reasons:

1. Initiating insertion at high rotation speed would introduce a very real danger of the bolt bending or flying loose.

2. Initiating high rotation speed when the bolt is still substantially protruding from the drilled hole introduces substantial differences in degree of mixing achieved between upper and lower ends of the bolt. The least amount of mixing would take place at the far end of the drilled hole, where the quality of grouting is the most critical.

The invention provides for two methods and means to achieve proper grout mixing, without continuing the mixing action longer than necessary. The first method involves the initiation of an automatic timer means, such initiation being precipitated by achieving the high thrust threshold at the conclusion of the bolt insertion step as described before. The automatic timer means then allows the low thrust and high speed mixing action to continue until a set time period has elapsed, such time period previously determined to be optimum to achieve proper mixing, on the average, for the grout under the circumstances under which such grout is installed. When said time period has elapsed, said timer means then causes the thrust applied to the head of the bolt to again increase to a high value while said timer means simultaneously stops any subsequent bolt rotation. It has been found that a suitable value exists for the high thrust value just mentioned, appropriate for the next step in the installation process: the step of providing for grout curing. In the typical case, values substantially in excess of optimum high thrust at this stage may crush the near surface layers of the rock to be reinforced, and in so doing deteriorate the rock structure. On the other hand, values much lower than the determined optimum may permit bed separations which may have developed in the rock strata to persist to a much greater degree, and thus detract from the competence otherwise attainable in the reinforced rock structure. The optimum value for the high thrust just discussed has been found to lie in the range of 2000 to 8000 lbs, depending primarily on the lithology of the rock strata involved. The second (and probably preferred) method to ensure proper duration of the mixing action according to the invention, involves the continuous monitoring of the torque required to drive the roof bolt in high speed rotation. Such torque needed to rotate the roof bolt has been found to rise sharply when the grout begins its initial set. As soon as sufficient torque rise is measured during the mixing step as described, mixing is completed and the torque monitoring means causes the rotation controlling means to stop rotation of the roof bolt. The value of torque which is indicative of completion of the mixing step varies to some degree with the length of the roof bolt employed, as well as with the type of resin employed. In the typical case using a five foot long roof bolt, a torque value of 70 lbft has been found practical. We have also found that due to inertial effects in a practical machine, the apparent torque measured may briefly rise to a value in excess of the torque value predetermined to be suitable to indicate completion of the mixing cycle (such as p. e. the value of 70 lbft mentioned above), immediately upon initiation of high speed rotation. To avoid the possibility of such initial high torque transient causing premature indication of completion of the mixing step, the output from the torque monitoring means is briefly suppressed immediately after initiation of high speed rotation.

It will be appreciated that it is necessary during such torque monitored mixing to ensure that thrust exerted to the roof bolt head is controlled to a suitably low and constant value, so that the torque measurement as described is truly indicative of the degree of mixing achieved within the grout, and not indicative of a variation of friction under the bolt head instead. Such constant low thrust control is provided as part of the roof bolt installation means as already described above, where it was discussed in connection with the need to avoid generating excessively high temperatures at the roof bolt head, as well as with the need to provide the capability to, in some cases, move the roof bolt a short distance further into the drilled hole as described, during the initial portion of the high speed rotation mixing cycle. When said torque measuring means has sensed that the grout mixing has been completed, the torque measuring means then causes the thrust applied to the head of the bolt to again increase to a high value while simultaneously causing the stopping of any subsequent bolt rotation, in the same fashion as described before for the case where a timer means was used to control the duration of the grout mixing cycle.

The means to insure sufficient curing of the grout prior to removal of the installation (and in the case of roof bolting: roof supporting) machinery, according to the invention, becomes the next step in the bolt installation cycle. The indication of completion of proper grout mixing obtained in the previous step of the bolt installation process either from timer means or from torque measurement means as described above, not only causes the cessation of bolt rotation and the increase of thrust applied to the bolt head to a predetermined high value as already discussed, but also causes initiation of a cure cycle timing means, separate and distinct from a mixing cycle timing means which might in some cases also be employed as discussed above. The cure cycle timing means thus begins timing and after a set time period has elapsed, predetermined to be sufficient and yet not excessive to attain sufficient strength within the grout to allow removal of the bolt installation machinery as described, the cure timer causes a visible or audible signal to be emitted. The roof bolting machine operator then has no doubt about when it will be safe and acceptable to move to the next bolt installation location.

The invention further provides the opportunity to include an additional installation step, which is valuable in connection with roof bolts which are not grouted along their full length, but only for a distance from their far end, their ungrouted portion to be tensioned after sufficient grout curing has taken place. These tensioned bolts were referred to above in the description of Problems with Current Practice and are generally known as "point anchor grouted bolts". When using such point anchor grouted bolts, the cure cycle timer means previously described, instead of causing a visible or audible signal to be emitted, first causes the following actions to be implemented in sequence, in mentioned additional installation step:

a—The thrust controlling means described earlier causes the thrust exerted on the roof bolt head to decrease from the high value described before for the grout cure cycle to a low constant value (the same value as was used before during the grout mixing cycle, p. e. 200 lbs, is a good value).

b—The rotation controlling means described earlier causes the roof bolt head to be rotated again, at a relatively slow (60 RPM has been found to work well) and constant speed.

c—A torque measuring means monitors the torque required to perform the rotation as described in step b. As the roof bolt is further tightened because of the rotation, it will be appreciated that said torque will increase, since the torque is a function of the tension in the roof bolt.

d—When the torque discussed in step c has risen to a value previously determined to be representative of the tension which is desired in the roof bolt for appropriate stability of the rock to be reinforced, the torque measurement means described in step c causes previously discussed rotation control means to stop any further rotation of the roof bolt head. In an additional implementation of the device to install grouted roof bolts, when rotation of the bolt head has been stopped as just described, a visible or audible indicating means can be caused to give clear indication that the roof bolt installation cycle has been totally completed.

Finally, the invention provides for means and method to apply a simple test to the grouted rock bolt, within its total installation cycle, to prove final reliability of that rock bolt. In the case of installation of a fully grouted roof bolt, said simple test is applied automatically, immediately after the timed grout cure period, which was discussed previously, has elapsed. The method of applying such simple test consists of applying a static test torque to the roof bolt head and relating said test torque to angular movement of the roof bolt head, which angular movement is measured simultaneously with the application of the static test torque mentioned. The timing of the application of mentioned simple test is critical; as was pointed out under the heading of Problems with Current Practice: if said test is applied too late, the grout becomes so strong that the test becomes meaningless; if said test is applied too soon, the grout has not yet cured sufficiently to withstand the test torque applied, even though the grout may be sound otherwise. During these measurements of torque and angular movement of the roof bolt head, thrust exerted on the bolt head is automatically held to a low constant value, in the same manner as it was described before for the final tensioning of a point anchor grouted bolt. For the case of the point anchor grouted bolt, the simple test invented is applied immediately after completion of final tensioning of the point anchor grouted bolt; for this case the simple test consists of applying a static test torque to the bolt head, where the static test torque is preferably equal in value to the torque applied earlier to the roof bolt head in order to obtain the final desired tension. While maintaining said static test torque on the roof bolt head, a standard, timed period (typically a few seconds) is permitted to elapse, during which period an angular deflection measurement means registers the angular movement which has taken place during said timed period. Excessive movement is then indicative of low quality grouting. In a different embodiment, the static test torque applied as described, decreases automatically if the angular movement as described increases to a predetermined value. In such a way the value of static test torque remaining at the conclusion of the described timed test period can serve as an indication of the quality of the grouting of the bolt. It will be appreciated that in most cases the latter version will provide a more sensitive and accurate indication of grouting quality.

In summary, the apparatus for implementing the methods to obtain control of the installation parameters of a grouted roof bolt, as described, in accordance with the invention, includes the following means: means to control thrust exerted on the roof bolt head; means to vary thrust applied to that roof bolt head back and forth from a high value to a low value, in response to a control signal; means to rotate and control rotation rate of said bolt head, means to start and stop rotation of said bolt head, in response to a control signal; and in some embodiments also means to measure and monitor torque applied to cause continuing rotation of said bolt head; in some embodiments also means to measure and monitor torque applied to said bolt head without continuing rotation, as well as means to measure angular movement of said bolt head; and means to relate said angular movement measurement and said torque measurement without continuing rotation in a manner appropriate to obtain visual indication of the adequacy of the cure of the grout of the same roof bolt; means to relate and synchronize in concert, the action of all devices and means as described.

BRIEF DESCRIPTION OF THE DRAWINGS

The accompanying drawings illustrate the principles of the invention, as well as certain preferred embodiments of the invention, in which:

FIG. 4 is a graphical representation of the relationship between thrust applied to the bolt head and time elapsed after the operator of the machine has initiated the automatic bolt installation cycle for a full-length grouted roof bolt.

FIG. 5 is a graphical representation of the relationship between rotation rate and time elasped after the operator of the machine has initiated the automatic bolt installation cycle for a point anchor grouted roof bolt.

FIG. 6 is a graphical representation of the relationship between torque applied to the bolt head and time elapsed after the operator of the machine has initiated the automatic bolt installation cycle for a point anchor grouted roof bolt.

FIG. 7 is a graphical representation of the relationship between thrust applied to the bolt head and time elapsed after the operator of the machine has initiated the automatic bolt installation cycle for a point anchor grouted roof bolt.

FIG. 8 is a representation of the principle of operation of the preferred embodiment for a torque measurement means capable of measurement of torque dynamically, as well as statistically (i.e., with or without rotation of the roof bolt).

DETAILED DESCRIPTION OF THE PREFERRED EMBODIMENTS

Figure 1:
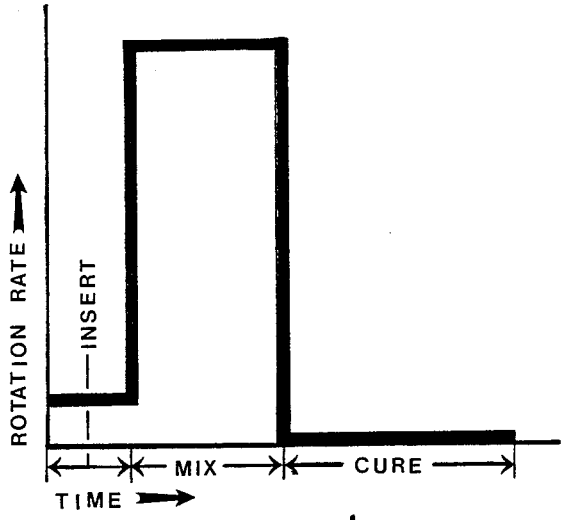
FIG. 1 is a diagrammatic representation of the preferred embodiment of the means necessary to install grouted roof bolts according to the invention.

Certain components of the preferred means to accomplish the objects of the invention, have been discussed in detail in several patents which have been issued to me previously: U.S. Pat. Nos. 4,300,397; 4,444,530 and 4,352,600, where such components were used in different combinations and for different purposes. A preferred embodiment of the invention is shown in FIG. 1, where the energy to install a grouted bolt is shown to originate from a Power Source. The Power Source is preferred to be a source of pressurized hydraulic oil, but can be derived in a number of different ways, as anyone skilled in the art of designing machinery will appreciate. The energy from the Power Source is led by a carrier conduit (in our preferred embodiment represented by a flow of pressurized oil through a hose or pipe) to a Power Modulating Means. The latter is, in this embodiment, a hydraulic circuit consisting of hydraulic valves, which are capable of controlling oil flow and oil pressure, in response to signals which are generated as will be described presently. In the preferred embodiment, the signals which control said hydraulic valves are pneumatic, and originate from the Computing Means, also shown in FIG. 1. There are three hydraulic circuits which in final analysis power the roof bolt installation means; these three circuits all derive from and are controlled by the Power Modulating Means, shown in FIG. 1, where those three circuits are indicated, respectively, by the nomenclature THRUST, CARRIER, and MOTOR. Again in the preferred embodiment, the THRUST circuit maintains a controlled hydraulic oil pressure against the lower surface of a sliding piston 1, which is capable of sliding along axis A, in such a manner that thrust is exerted on the roof bolt head 2 to the degree and in the magnitude necessary to accomplish each bolt installation step as described above in the Summary of the Invention. It should be apparent that the amount of sliding or travel of said piston which can be made available within a practical physical structure must be limited. In the preferred embodiment the available distance for such sliding or travel is somewhat less than one inch. The physical device which contains axes A, B and C in FIG. 1, is mounted on and held in position by a conventional arrangement which is not shown in FIG. 1, but which, on some roof bolting machines is known as a "boom", on other roof bolting machines as a "mast". The "boom" or "mast" normally has a lifting mechanism associated with it, which enables the machine to lift mentioned device containing the axes A, B, and C up or down, in contact with or away from the roof bolt. Said lifting mechanism is normally controlled manually by the operator of the roof bolting machine. The invention provides the additional capability to perform described lifting action, up or down, automatically as required while performing any installation sequences according to the invention as described before. Such automatic lifting up or down is accomplished by modulating the power hydraulic line labelled CARRIER in FIG. 1 on up, on down, or off. The control of power (on up, on down, or off, as described) of the CARRIER circuit is arranged in such a way that, whenever the roof bolt installation means is within an installation cycle, i.e., whenever a roof bolt is in the process of being installed, the CARRIER circuit is actuated in such a way that piston 1 is kept within its available travel range as described above. The preferred means to indicate that piston 1 may be in danger of exceeding its available range is two simple limit switch means, which, in the preferred embodiment are pneumatic camroller valves, although other means, such as electric limit switch means would work also. Said limit switch means are not shown in the drawings, but are arranged in such a way that one limit switch means emits a signal when piston 1 is in danger of exceeding its available travel distance in one direction, and the other limit switch means emits a signal when piston 1 is in danger of exceeding its available travel distance in the other direction. The signals emitted as just described then cause the Power Modulating Means to constantly urge the "boom" or "mast" lifting action in the direction appropriate to maintain piston 1 generally in the center portion of its available travel range.

Figure 2:
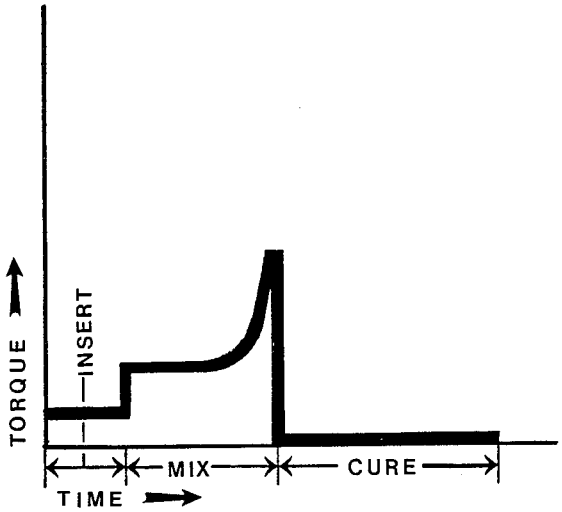
FIG. 2 is a graphical representation of the relationship between rotation rate and time elapsed after the operator of the machine has initiated the automatic bolt installation cycle for a full-length grouted roof bolt.
Figure 3:
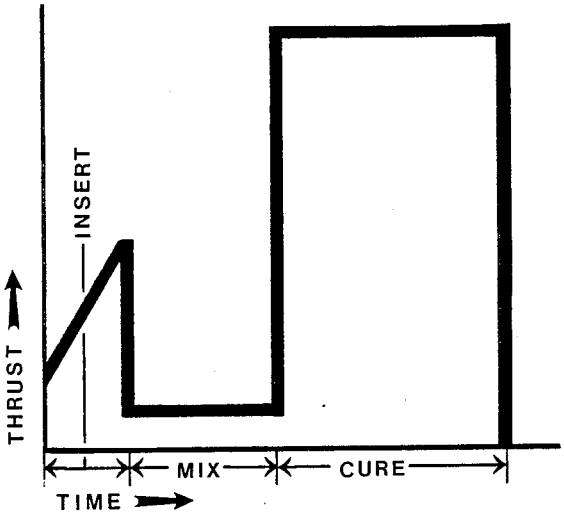
FIG. 3 is a graphical representation of the relationship between torque applied to the bolt head and time elapsed after the operator of the machine has initiated the automatic bolt installation cycle for a full-length grouted roof bolt.

The third hydraulic oil circuit which emanates from the Power Modulating Means, and which is labelled MOTOR, controls the action of the drive motor 3, in FIG. 1. In the preferred embodiment, drive motor 3 is a hydraulic motor. As described before under Summary of the Invention, the action of the drive motor consists of three possible states: on at high speed, on at low speed, and off, since the drive motor 3 is rotationally coupled to rotation output means 4. The signals which cause the Power Modulating Means to change the oil supply to drive motor 3 as required for the bolt installation sequences as described before, are generated in the Computing Means. In the preferred embodiment, drive motor 3 drives a chain 5, which is shown in side view in FIG. 1, and in top view in FIG. 8. Chain 5 causes rotation of shaft 6 in FIG. 1, which in turn drives chain 7, through sprockets as shown. Chain 7, finally, drives cylinder 8 in rotation. Cylinder 8 contains piston 1, which was discussed earlier. Note that in the arrangement described piston 1 is capable of being driven in rotation, as well as of moving axially. To accomplish this dual motion, piston 1 is assembled rotationally rigidly to cylinder 8 by means of a sliding spline means, and for the preferred embodiment, a ball spline means is employed to minimize axial friction between the sliding members described. This particular arrangement is discussed further in my previously issued patent. U.S. Pat. No. 4,300,397. FIG. 8 further shows an advantageous arrangement of the preferred embodiment in which the drive torque transmitted through drive chains 5 and 7, can be measured continuously. Shaft 6 which is co-axial with axis B, is mounted in bearings (not shown) which in turn are fastened to a frame 9. Frame 9 is mounted in such a fashion that it is capable of pivoting around axis A. When the drive motor is called upon to exert a torque in order to drive a torsional load at the roof bolt head, force vectors in the chains 5 and 7 add up in such a way as to cause said pivoting motion of frame 9. Frame 9 is prevented from traveling very far in the described pivoting direction by force measurement means 10 and 11. In the preferred embodiment, force measurement means 10 and 11 are plunger actuated air pressure regulating devices, which can be seen in FIG. 8 to be mounted in such a way that an increasing force exerted by frame 9 in one direction causes the air pressure regulated by force measurement means 10 to increase, and an increasing force exerted by frame 9 in the other direction causes the air pressure regulated by force measurement means 11 to increase. Air pressure output from force measurement means 10 is then representative of and proportional to the torque delivered to the roof bolt head 2, when said roof bolt head is driven in right hand rotation. Force measurement means 11 is used to provide capability of improved sensitivity in a static torque test to a roof bolt at the end of its installation cycle, as will now be described in detail. In the preferred embodiment, a static torque test is performed as follows: drive motor 3 is off and in "free wheeling" mode, then locking means 12, which can be made similar to a conventional clutch or disc brake, and can be actuated hydraulically or pneumatically, locks in such a way that frame 9 and cylinder 8 become in effect one rigid assembly, and relative rotational motion is no longer possible between 9 and 8. It may be appreciated that there exist several alternate locations for locking means 12. Locking means 12, for example can be built around cylinder 8. Alternatively, locking means 12 can be built as part of the assembly which includes shaft 6: it is this alternate location which is shown in FIG. 1. The next event in the sequence of event which makes up the static torque test, is pressurization of cylinder means 13, which then extends its rod 14 and thereby exerts a force on frame 9, causing frame 9 to attempt to pivot around axis A. Since frame 9 and cylinder 8 are now, in effect, one rigid assembly as just described, the pivoting motion about axis A is resisted by the roof bolt 2, which is still coupled to the installation machine. If the roof bolt 2 yields somewhat in rotation, allowing some further extension of rod 14, frame 9 causes the plunger of force measurement means 11 to be depressed. The latter action causes force measurement means 11 to increase its output air pressure, while it returns a reaction force to frame 9 in proportion. An examination of the force balance on frame 9 shows that for any particular and constant value of force exerted by cylinder means 13, the output of force measurement means 11 defines a specific combination of torsional deflection and torsional resistance offered by the roof bolt under test. Under the circumstances described, the higher the output from force measurement means 11, the lower the stiffness, and thereby the strength of the roof bolt. Contemplation of the principles shown in FIG. 8 reveals that many equivalent means exist to obtain the measurement of quality of strength of the grouted roof bolt at a specifically defined time immediately upon installation of that same roof bolt. For example, it would be possible to replace force measurement means 11 with a limit switch means, which indicates when excessive deflection is encountered under the application of a constant test torque to the roof bolt 2, by pressuring cylinder means 13. The exact same multiplicity of arrangements as just described to test the stiffness, and thereby the quality of a fully grouted roof bolt (performed at a specific time soon after the installation of that grouted bolt) can be utilized to apply a test after completion of installation of a point anchor (tensioned) grouted roof bolt. Such a test applied to a point anchor grouted roof bolt would disclose first the torque required to turn the bolthead slightly more, and thereby the tension carried by that bolt. If the test torque applied by pressurization of cylinder 13 is then maintained for a short period of time, observation of possible further movement of frame 9 during such additional period of time, as signaled by force measurement means (or, in another embodiment, limit switch means, as discussed above) 11, would be indicative of insufficient curing of the grouted portion of the point anchor bolt assembly prior to final tensioning of the roof bolt. Any signals generated by force measurement means 10 and 11 at any time during the roof bolt installation cycle are used as input for the Computing Means shown in FIG. 1. As has been mentioned before, the preferred embodiment which has been tested and shown to be reliable in the hostile environment of an underground coal mine, uses pneumatic valves to perform the logic and computations required in the Computing Means. For the same reasons of reliability, pneumatic means is advocated for determination of elapsed time periods necessary as described before in the Summary of the Invention. Such Timing Means are shown in FIG. 1 by a separate block connected to the Computing Means. The Computing Means could clearly also be built using electric or electronic components, in place of the pneumatic components used. In any case it is possible for anyone skilled in the arts to construct the Computing Means, using the information contained in this application as a guide, otherwise using known principles. To additionally clarify, and assist in any design construction of a device according to the invention, FIGS. 2, 3 and 4 show how the installation parameters (respectively, the variation with time of bolthead rotation rate, torque applied to the bolt head, and thrust exerted on the bolt head) for a fully grouted roof bolt relate to the Computing Means and to each other. Similarly, FIGS. 5, 6 and 7 show the same relationship for a point anchor partially grouted (and tensioned) roof bolt.

The provision of means to measure torque delivered by the device to install grouted roof bolts, according to the invention, can be advantageously extended to solve another problem which exists in practice: when the hole is drilled in the rock to receive a rock bolt to be installed, reasonable accuracy in drilling that hole to the proper depth is critical. If the hole is not drilled deep enough, the rock bolt cannot be driven completely in and the roof plate under the rock bolt head is left loose. If the hole is drilled too deep, a substantial fraction of the grout may be lost in filling the extra volume, thus being unavailable where it is needed to perform its reinforcing function: in the space surrounding the rock bolt. In conventional practice, the machine operator watches the drill steel as it advances into the hole and stops drilling when he observes that the steel has entered the hole to the proper length. Because of poor visibility and other factors, actual hole depth is often poorly controlled. It is not immediately feasible to fasten a stop to the drill thrusting mechanism, since the relationship of this mechanism to the surface of the rock varies considerably from hole to hole. It is potentially dangerous to fasten a stop to the drill steel itself, because of the forces involved when such a stop would contact the rock surface at full drilling thrust and rotation rate. It is, however, possible and practical to fasten a small torque generator to the drill steel. Such a torque generator can be nothing more than a hardened collar, with the outside diameter tapered to gradually present more surface to the rock, as it enters the hole being drilled. The necessary maximum diameter of such a torque generator has been found to be no more than twice the diameter of the drill steel used. The torque generator is fastened to the drill steel at the point which enters the rock when the hole being drilled has attained proper depth for the rock bolt to be used. As the tapered exterior of the torque generator is forced into the hole, more surface is in contact with the rock and the torque required to maintain rotation increases. It then becomes a simple matter to arrange for a limit switch means in combination with the torque measurement means already described to give a control signal when the torque being monitored exceeds a predetermined value. Described control signal can then be made to cause emission of a warning signal, as well as automatic halting of the drilling action, by stopping rotation and thrust. It has been found that the combination of devices described to monitor drilling torque and emitting a control signal when a predetermined torque level is exceeded can also be used advantageously in applications in rock bolting where the ground being drilled tends to bind the drill steel from time to time. In such cases, the Computer Means is arranged to stop thrust, or actually slightly withdraw the drill steel from the hole, when a torque rise is signalled as described. Drill rotation for such an application is then not halted, but maintained. As the drill bit then cuts itself free under the no-thrust condition, the torque which is still being monitored, drops down to a much lower value again, which causes the Computer Means to reapply normal drilling thrust and thus resuming normal drilling.

The means and method of installing roof bolts according to the invention, allow improved control over the grout curing process. If desired, the invention also makes it possible, during the production process of installing roof bolts, to identify those grouted bolts which still do not attain a satisfactory cure or bond to the rock to be reinforced. Since the control and testing of the grouted bolts is applied during the installation process of roof bolting, inadequate bolt quality may be identified immediately, while the installation machinery is still in position, so that additional grouted bolts may be installed as a supplement as necessary, before temporary roof support is removed.

It is apparent that the various devices described above can be executed in such a manner that they can be readily inserted in series with an existing roof bolt tightening means, as well as executed so that said devices form an integral part of the roof bolt tightening means.

While I have shown and described several embodiments in accordance with the present invention, it is obvious that the same is not limited thereto, but is susceptible to numerous changes and modifications as known to those skilled in the art, and I therefore do not wish to be limited to the details shown and described herein but intend to cover all such changes and modifications as are encompassed by the scope of the appended claims.

I claim:

1. A method of using torque control to improve quality and safety of a grouted rock bolt installation by insuring sufficient mixing of grout and thereby completeness of cure of said grout while avoiding excessive mixing of said grout which said excessive mixing destroys chemical links formed within said grout, by, in sequence, performing the steps of:

rotating a rock bolt to mix said grout;

continuously monitoring, torque applied to a head of said rock bolt as required to perform high speed rotation; and stopping said rotation, and thereby said mixing, when said monitored torque rises sufficiently, as indicated by a sharp rise in the torque value, above a predetermined torque value indicative of completion of said mixing.

2. A method as in claim 1, characterized in that quality and productivity of a grouted rock bolt installation are further enhanced by adding the additional step of automatically timing a cure period following the steps described in claim 1.

3. A method as in claim 1, characterized in that it includes brief suppression of output from a torque monitoring means immediately after initiation of high speed rotation to avoid a brief rise in torque value due to inertial effects, which rise in torque value causes premature indication of completion of mixing.

* * * * *